US007278961B2

(12) United States Patent
Takahashi et al.

(10) Patent No.: US 7,278,961 B2
(45) Date of Patent: Oct. 9, 2007

(54) CENTRIFUGAL SEPARATOR

(75) Inventors: Hiroyuki Takahashi, Ibaraki (JP); Masahiro Inaniwa, Ibaraki (JP); Yoshitaka Niinai, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/327,434

(22) Filed: Jan. 9, 2006

(65) Prior Publication Data

US 2006/0178253 A1 Aug. 10, 2006

(30) Foreign Application Priority Data

Jan. 11, 2005 (JP) ..... P2005-003603

(51) Int. Cl.
*B04B 7/06* (2006.01)

(52) U.S. Cl. ..... 494/12; 494/16

(58) Field of Classification Search ..... 494/1, 494/7–12, 16–21, 84; 210/85, 144, 363
See application file for complete search history.

(56) References Cited

U.S. PATENT DOCUMENTS 3,633,041 A * 1/1972 Koskela ..... 494/1
5,280,975 A * 1/1994 Tscheu et al. ..... 494/12
6,241,650 B1 * 6/2001 Letourneur ..... 494/11
2006/0166801 A1 * 7/2006 Takahashi ..... 494/12
2006/0178253 A1 * 8/2006 Takahashi et al. ..... 494/12

FOREIGN PATENT DOCUMENTS

| | | | |
|---|---|---|---|
| DE | 2816395 A1 | * | 10/1979 |
| JP | 60-20753 | | 6/1985 |
| JP | 7-275738 | * | 10/1995 |
| JP | 09-187428 | | 7/1997 |

* cited by examiner

*Primary Examiner*—Charles E. Cooley
(74) *Attorney, Agent, or Firm*—Mattingly, Stanger, Malur & Brundidge, P.C.

(57) ABSTRACT

A centrifugal separator is configured such that a switching unit adapted to be brought into electrical conduction or into electrical nonconduction is electrically connected between a motor housing and a motor-ground connection wire, and that the switching unit is controlled to be brought into nonconduction when a door is closed.

11 Claims, 3 Drawing Sheets

CENTRIFUGAL SEPARATOR

BACKGROUND OF THE INVENTION

1. Field of the Invention

The present invention relates to the safety structure of a centrifugal separator and, more particularly, to a grounding structure for enhancing the electrical safety of a centrifugal separator.

2. Description of the Related Art

The centrifugal separator is configured so that a rotor caused through a tube and a bottle to hold a sample to be separated is accommodated in a rotor chamber (rotating chamber), and that the rotor is rotated at high speed by a drive unit, such as a motor, in a case where an opening portion of the rotor chamber is hermetically closed by a door, to thereby separate and purify the sample held by the rotor. The rotational speed of the rotor varies with the use thereof. Generally, there are provided families of products having rotational speeds that widely range from a relatively low speed, the maximum value of which is about several thousands revolutions per minute (rpm), to a high speed, the maximum value of which is about 150,000 rpm.

FIG. 5 shows the configuration of a known centrifugal separator. The centrifugal separator comprises a motor housing (casing) 5 of a motor 5*a* serving as a rotary drive source, a rotating spindle (shaft) 5*b* rotatably connected to the motor 5*a*, a rotor 1 fixed to the rotating shaft 5*b* and adapted to hold a sample to be separated, a rotor chamber 2 adapted to accommodate the rotor 1 and to have an opening portion 2*a* in the top surface thereof, a door 3 openably/closeably provided in the opening portion 2*a* of the rotor chamber 2, a door lock mechanism 4 adapted to restrict the opening/closing of the door 3, a door opening/closing detector 12 adapted to detect the opening/closing of the door 3, and a control unit 60 adapted to control the motor 5*a* and the door lock mechanism 4. The motor housing 5, the rotor chamber 2, the door lock mechanism 4, and the control unit 60 are accommodated in the casing (frame) 10.

When the door 3 of the rotor chamber 2 is opened, a user may touch the rotating shaft 5*b* of the motor 5*a* and the rotor 1 that may electrically be conducted to the rotating shaft 5*b*. Thus, generally, an electrically insulating layer is provided between the winding of the motor 5*a* and the rotating shaft 5*b* to thereby prevent a user from getting an electrical shock.

Further, in consideration of the possibility that such an insulating layer may cause dielectric breakdown to thereby generate a power supply voltage on the rotating shaft 5*b*, electric shock guard means are doubled by electrically grounding the housing 5 of the motor 5*a* through a ground connection wire 8. Usually, the casing 10 of the centrifugal separator is connected to a ground connection wire 9. Thus, the ground connection wire 8 of the motor housing 5 is electrically connected to a part of the casing 10 of the centrifugal separator placed in the vicinity of the motor housing 5. Incidentally, the value of a leakage current of the centrifugal separator is limited to a value, which is predetermined according to JIS (Japanese Industrial Standards) safety standard or to IEC (International Electrotechnical Commission) safety standard, or less. Also, it is required to place a plurality of electric shock guard means at members of a centrifugal separator, which have possibilities of being touched by users.

Meanwhile, the motor 5*a* generates a leakage current due to the stray capacitance generated between the wiring and the housing 5 of the motor is generated in the ground connection wire and has the property of increasing the entire leakage current flowing in the casing of the centrifugal separator. Thus, it is sometimes difficult to limit the value of the leakage current to a regulation value, which is predetermined according to the aforementioned safety standards, or less. Consequently, the leakage current is reduced by using an insulation transformer 13 that needs no ground connection wire at a secondary side thereof, as shown in FIG. 4.

Furthermore, although it is effective in reducing a leakage current to remove the ground connection wire 8 of the motor housing 5, it is necessary for realizing the plurality of electric shock guard means after the removal of the ground connection wire 8 of the motor housing 5 to provide double insulation or reinforced insulation, which is equated with the double insulation, in the motor itself.

Incidentally, regarding the related art, JP-UM-B-60-20753 discloses the technique of preventing occurrence of an electric shock by providing an electrical insulating layer between the rotor winding and the rotating shaft of a motor, or what is called a double insulation technique of constructing also a motor casing by an insulating material. Further, JP-A-9-187428 discloses the technique of preventing the generation of a leakage current by using the insulation transformer.

The aforementioned structure of the motor, which employs the double insulation or the reinforced insulation, is advantageous in removing the ground connection wire of the housing of the motor and in reducing the leakage current and has a problem in that the cost thereof increases because of the structure thereof.

Further, even when the double insulation or the reinforced insulation of the motor or the motor housing is performed, the motor itself is sometimes charged. Electrification voltages therefor are regulated according to the JIS standard and the IEC standard. In a case where the electrification voltage exceeds a predetermined regulation value, there is a problem that the ground connection wire of the motor housing cannot be removed to prevent the electrification of the motor. Conversely, in a case where the value of a leakage current exceeds a predetermined regulation value when the ground connection wire of the motor is used, there is another problem in that it is necessary to take countermeasures against the leakage current, for example, to distance a drive circuit, which generates a leakage current, from the casing of the centrifugal separator, or to prevent the generation of a leakage current by readjusting the constant and the configuration of an electric noise suppression circuit that generates a leakage current.

SUMMARY OF THE INVENTION

Accordingly, an object of the invention is to provide a centrifugal separator enabled by employing a relatively simple configuration to reduce a leakage current and realize double prevention of occurrence of an electric shock without using the high-cost insulation transformer and without the double insulation or the reinforced insulation structure of the motor and without unnecessarily charging the motor.

The above and other objects and novel features of the invention will become more apparent from the following description and the accompanying drawings.

Inventors of the present invention focus attention on the following specificities of the centrifugal separator and have created the present invention. That is, usually, the centrifugal separator is configured so that during an operation thereof, the door of the rotor chamber is locked and is inhibited from opening, thereby to ensure safety against unexpected mechanical damage in operation. Therefore, the inventors focus attention on the fact that because the door is closed, a user of the centrifugal separator cannot touch the rotating shaft of the motor and the rotor in operation, so that occurrence of an electrical shock due to the user's touch on the motor or on the motor housing can be prevented. Consequently, the electric shock guard can be doubled. Thus, the grounding of the motor housing can be omitted. Meanwhile, when the centrifugal separator is stopped, a user can open the door and touch the rotor and so on. Thus, the motor housing having neither a double insulation structure nor a reinforced insulation structure needs ground connection. However, during the centrifugal separator is stopped, a leakage current from the motor is reduced because a switching circuit, such as an inverter or the like of a motor drive circuit, is stopped, so that the circuit is interrupted. The inventors also focus attention on this fact.

Outlines of the representative aspects of the invention disclosed in the present application are described as follows.

(1) According to an aspect of the invention, there is provided a centrifugal separator having a motor housing that incorporates a motor serving as a rotary drive source, a rotating shaft rotatably connected to the motor, a rotor fixed to the rotating shaft and adapted to hold a sample to be separated, a rotor chamber adapted to accommodate the rotor and to have an opening portion in a top surface thereof, a door openably/closeably provided in the opening portion of the rotor chamber, a door lock mechanism adapted to restrict the opening/closing of the door, a door opening/closing detector adapted to detect opening/closing of the door, a control unit adapted to control the motor and the door lock mechanism, a casing adapted to accommodate the motor housing, the rotor chamber, the door lock mechanism, and the control unit, and to have an open part at the opening portion in the top surface of the rotor chamber so that the door is openably and closeably provided in the open part, and a ground connection wire adapted to electrically ground the motor housing. This centrifugal separator features that a switching unit adapted to be brought into electrical conduction or into electrical nonconduction is electrically connected between the motor housing and the motor-ground connection wire, and that the switching unit is controlled by the control unit to be brought into nonconduction when the door is closed.

(2) An embodiment of the centrifugal separator of the invention described in the item (1) features that when the door is closed and the door lock mechanism locks the door, the switching unit is brought into nonconduction.

(3) An embodiment of the centrifugal separator of the invention described in the item (1) features that when the door is closed and the motor rotates, the switching unit is brought into nonconduction.

(4) An embodiment of the centrifugal separator of the invention described in the item (1) features that when the door is closed and the rotational speed of the motor exceeds a predetermined rotational speed, the switching unit is brought into nonconduction.

(5) According to another aspect of the invention, there is provided a centrifugal separator having a motor housing that incorporates a motor serving as a rotary drive source, a rotating shaft rotatably connected to the motor, a rotor fixed to the rotating shaft and adapted to hold a sample to be separated, a rotor chamber adapted to accommodate the rotor and to have an opening portion in a top surface thereof, a door openably/closeably provided in the opening portion of the rotor chamber, a door lock mechanism adapted to restrict the opening/closing of the door, a control unit adapted to control the motor and the door lock mechanism, a casing adapted to accommodate the motor housing, the rotor chamber, the door lock mechanism, and the control unit, and to have an open part at the opening portion in the top surface of the rotor chamber so that the door is openably and closeably provided in the open part, and a ground connection wire adapted to electrically ground the motor housing. This centrifugal separator features that a switching unit adapted to be brought into electrical conduction or into electrical nonconduction is electrically connected between the motor housing and the motor-ground connection wire, and that the switching unit is controlled by the control unit to be brought into nonconduction when the door lock mechanism locks the door.

(6) An embodiment of the centrifugal separator of the invention described in the item (5) features that when the motor rotates, the switching unit is brought into nonconduction.

(7) An embodiment of the centrifugal separator of the invention described in the item (5) features that when the rotational speed of the motor exceeds a predetermined rotational speed, the switching unit is brought into nonconduction.

According to the invention, the reduction in the leakage current and the doubling of the electric shock guard means can be achieved by controlling the ground connection wire of the motor housing to be brought into conduction or nonconduction. Thus, the necessity for performing the addition of the insulation transformer and the double insulation or the reinforced insulation of the motor, which are needed by the related art, can be eliminated. Consequently, a low-cost centrifugal separator having a simple configuration can be provided.

DETAILED DESCRIPTION OF THE PREFERRED EMBODIMENTS

Figure 1:
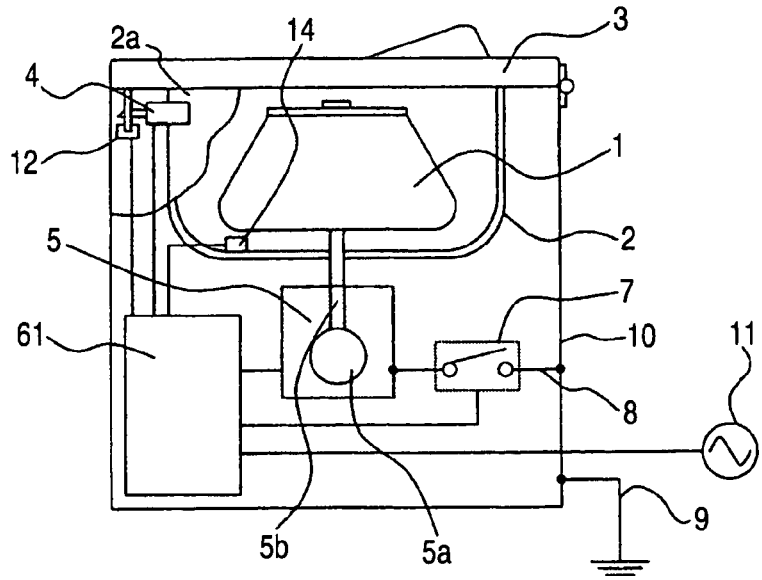
FIG. 1 is a view illustrating the configuration of a centrifugal separator according to an embodiment of the invention.

Hereinafter, an embodiment of the invention is described in detail with reference to the accompanying drawings. Incidentally, same reference numerals designate members having the same functions throughout figures illustrating the embodiment. Thus, redundant descriptions of such members are omitted herein. Further, members having the same functions as those of corresponding members of the related art are denoted by the same reference numerals as those denoting the corresponding members.

Figure 2:
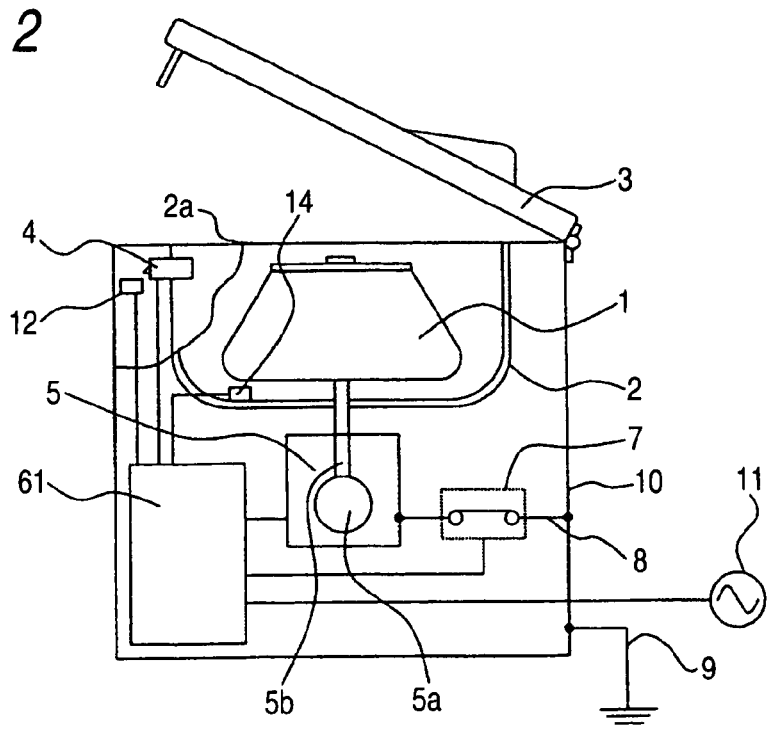
FIG. 2 is a view illustrating a state, in which a door is opened in the centrifugal separator according to the invention shown in FIG. 1.

FIGS. 1 and 2 are views illustrating the configuration of a centrifugal separator according to an embodiment of the invention. Particularly, FIG. 1 is a view illustrating a state in which a motor 5*a* is driven by a control unit 61 (to be described later). FIG. 2 is a view illustrating a state in which the driving of a motor 5*a* is stopped by the control unit 61, and in which a rotor 1 is stopped. The centrifugal separator has a metallic casing (frame) 10, which is, for example, quadrangular in cross section viewed from top. The centrifugal separator also has a metallic housing (casing) 5 that is provided in the frame and that incorporates the motor 5*a*, which is fabricated and is accommodated therein and serves as a rotary drive source. The centrifugal separator also has a metallic rotating spindle (shaft) 5*b* rotatably connected to the motor 5*a*, the rotor 1 that is made of a metallic material (for instance, an aluminum based alloy) and that holds a sample to be separated, a rotor chamber 2 that accommodates the rotor 1 and has an opening portion 2*a* in the top surface thereof, a door 3 freely openably provided in the opening portion 2*a* of the rotor chamber 2 that is formed in the casing 10, a door lock mechanism 4 adapted to restrain the opening/closing of the door 3, a door opening/closing detector 12 adapted to detect the opening/closing of the door 3, a switching unit 7 inserted into the path of a ground connection wire 8, a rotation detector 14 adapted to detect the rotational speed of the rotor 1, and a control unit 61 adapted to control the motor 5*a*, the door lock mechanism 4, and the switching unit 7. The casing 10 is electrically connected to the earth through a ground connection wire 9 and is adapted to feed a leakage current, which flows through the casing 10, to the earth.

The motor 5*a* is constituted by, for example, an induction motor. Although not shown, a drive circuit for this motor is constructed in the control unit 61 and is supplied with electric power by a power supply 11. The power supply 11 is constituted by a commercial ac power supply adapted to provide 100V or 200V (50/60 Hz). This commercial ac power supply voltage is converted into a three-phase ac power supply voltage of 300V (5 Hz to 2.6 kHz) This commercial ac power supply is used as a drive power supply for the induction motor. That is, the voltage supplied from the power supply 11 is boosted through an inverted constructed in the control unit 61. The boosted voltage is supplied to the winding wire of the motor 5*a*. Thus, there is a fear that a relatively large leakage current may flow in the motor housing 5 through the stray capacitance according to a high drive voltage or an induced surge voltage (noise voltage) during the operation of the motor 5*a*. Further, there is a fear that a low commercial ac voltage causes a relatively small leakage current to flow in the motor housing 5 through the stray capacitance of the inverter and so on during the motor 5*a* is stopped. Furthermore, the leakage current flowing in the motor housing 5 is passed through the switching unit 7 inserted into the path of the ground connection line 8 of the motor housing 5 and is supplied to the ground connection wire 9 of the casing 10, so that the motor housing 5 is grounded. The opening/closing of the switching unit 7 inserted according to the invention (the conduction/nonconduction of electricity in the switching unit 7) is controlled by the control unit 61. This switching unit 7 is constituted by, for example, an electromagnetic switch (electromagnetic relay).

Figure 3:
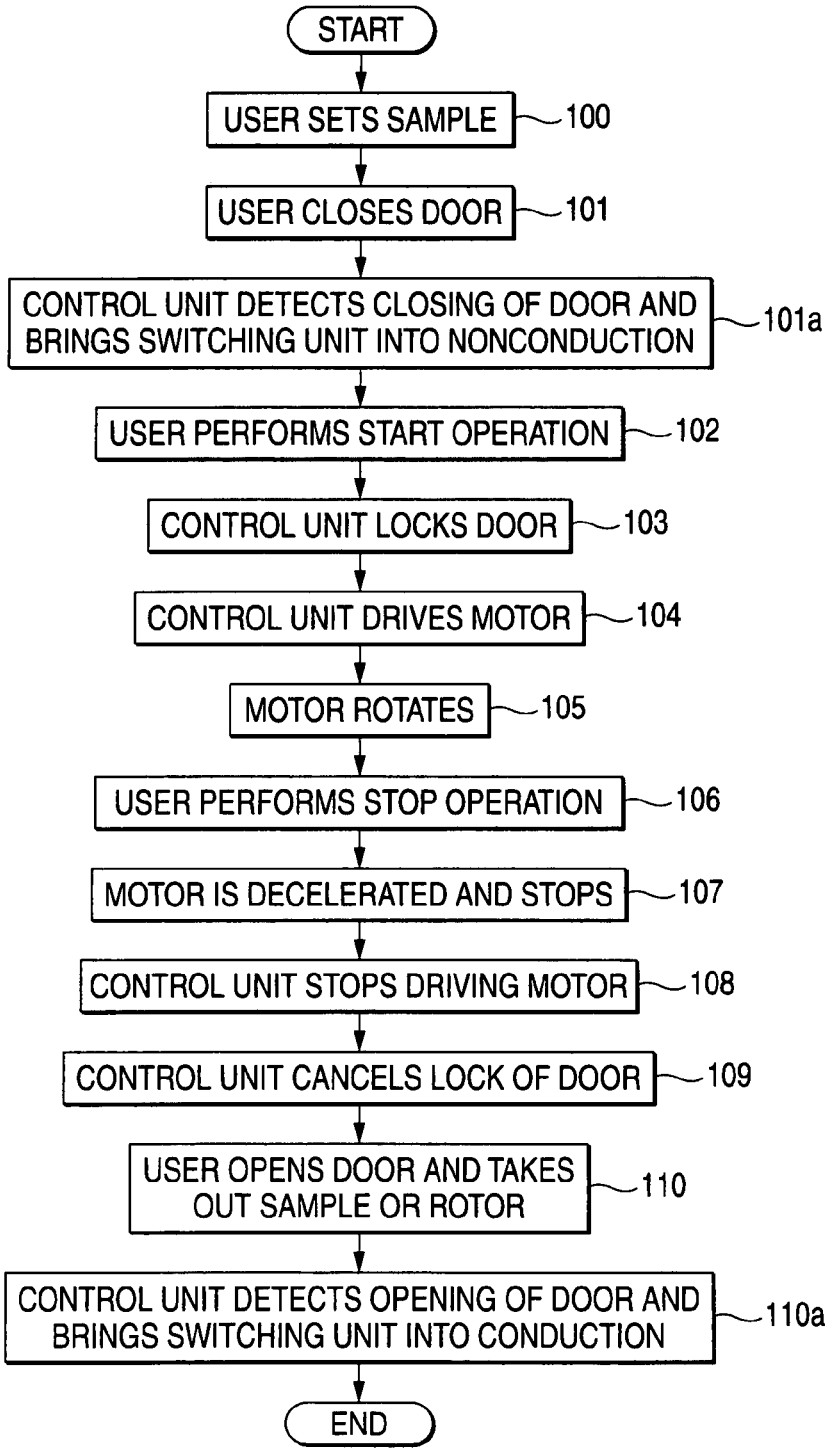
FIG. 3 is a flowchart illustrating an operation of the centrifugal separator according to the invention shown in FIG. 1.
Figure 4:
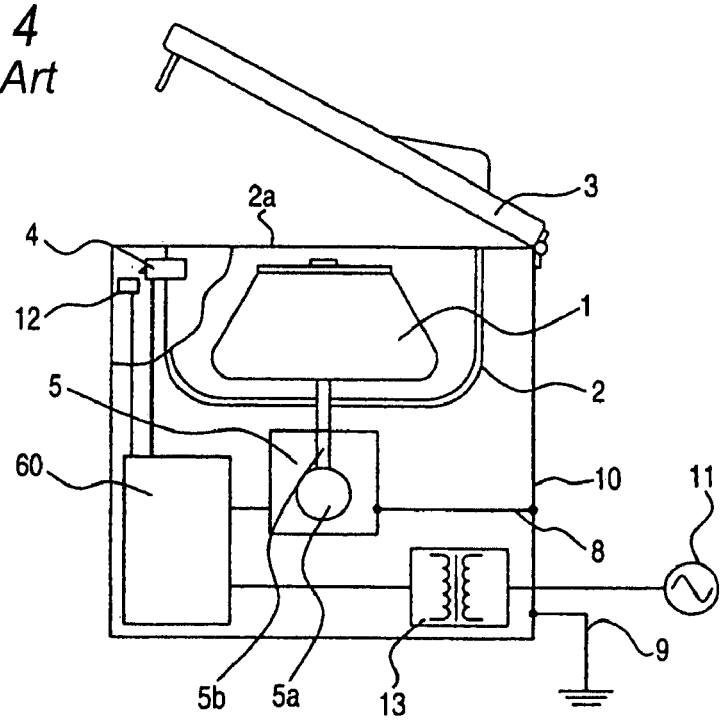
FIG. 4 Prior Art
FIG. 4 is a view illustrating the configuration of an example of a related centrifugal separator.
Figure 5:
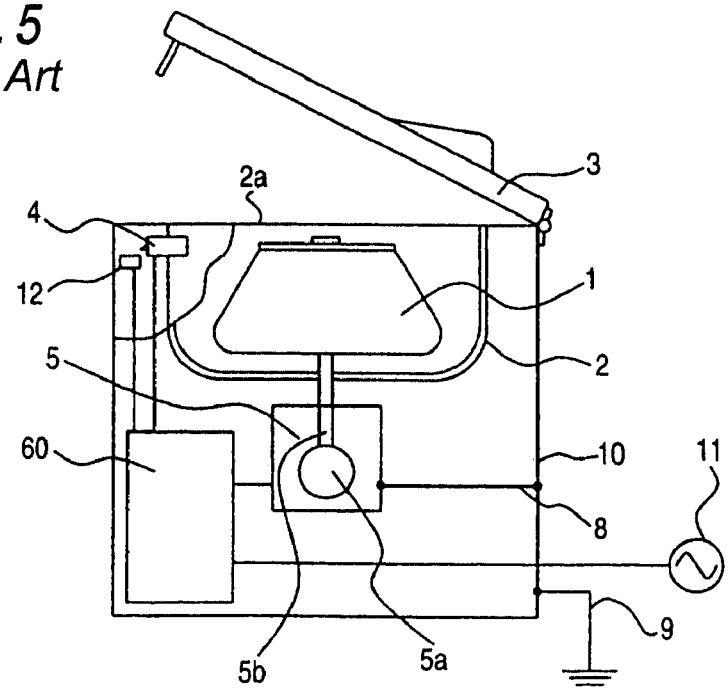
FIG. 5 Prior Art
FIG. 5 is a view illustrating the configuration of another example of a related centrifugal separator.

Next, an operation of the switching unit 7 is described below with reference to a flowchart illustrated in FIG. 3.

First, a user sets a sample, which is to be separated, in the rotor 1 in step 100. Then, the user closes the door 3 in step 101. At that time, the control unit 61 receives a detection signal from the door opening/closing detector 12 and judges that the door 3 is in a closed state. Then, the control unit 61 brings the switching unit 7 into a nonconduction state (interruption state) in step 101*a*. Subsequently, the user pushes a start button (not shown) of the centrifugal separator and starts centrifugal separation in step 102. The control unit 61 first operates the door lock mechanism 4 and locks the door 3 in step 103. Then, the control unit 61 starts driving the motor 5*a* in step 104. After a while, the motor 5*a* starts rotating. The control unit 61 judges from a detection signal sent from the rotation detector 14 in step 105 that the rotor 1 rotates.

Such an operation brings the motor into a driven state in steps 104 and 105. Thus, a high driving voltage and an induction surge voltage (noise voltage) are generated in the motor 5*a* and are propagated to the motor housing 5 through the stray capacitance. However, the switching unit 7 is in a nonconduction state, so that electric current due to the propagated voltage does not flow in the ground connection wire 9 of the casing 10 of the body of the centrifugal separator. Consequently, the reduction of the leakage current flowing through the ground connection wire 9 of the casing 10 to a safety standard value, which is determined according to the JIS safety standard or to the IEC safety standard, or less is facilitated. Further, the lock of the door 3 to prevent a user from touching the rotor 1 serves as the electric shock guard means. In addition to the insulation of the motor 5*a*, this electric shock guard means maintains the realization of a plurality of electric shock guard means.

On the other hand, when the user finishes the centrifugal separation by pushing a stop button (not shown) of the centrifugal separator in step 106, the control unit 61 drives the motor 5*a* to reduce the speed. After a while, the motor 5*a* stops in step 107. Then, the control unit 61 stops driving the motor 5*a* in step 108. Also, the control unit 61 terminates the operation of the door lock mechanism 4 and cancels the lock of the door 3 in step 109. Thereafter, the user opens the door 3 and takes out the sample and so on in step 110. At that time, the control unit 61 judges from a signal sent from the door opening/closing detector 12 that the door 3 is in an opened state. Then, the control unit 61 brings the switching unit 7 into a conduction state (connection state) in step 110*a*.

At that time, the control unit 61 does not drive the motor 5*a*. Thus, a voltage propagated from the motor 5*a* to the motor housing 5 is low. Also, a leakage current flowing from the motor housing 5 to the casing 10 is small. Consequently, the reduction of the leakage current to the safety standard value or less is facilitated. Further, the plurality of electric shock guard means prescribed according to the safety standards can be realized by the insulation of the motor 5*a* and the grounding of the motor housing 5, which is achieved by the ground connection wire 8, the casing 10, and the ground connection wire 9.

In the aforementioned embodiment, the switching unit 7 is controlled by the control unit 61 according to a door opening/closing signal outputted by the door opening/closing detector 12 in steps 101*a* and 110*a*. However, in step 103, the switching unit 7 may be brought into nonconduction, according to the lock of the door 3. Also, in step 109, the switching unit 7 may be brought into conduction according to the cancellation of the lock of the door 3.

Further, the control of the switching unit 7 to be brought into nonconduction may be performed when the control unit 61 drives the motor 5*a*. Furthermore, in a case where a predetermined rotational speed of the motor 5*a*, at which the leakage current to the motor housing 5 increases, is known, the switching unit 7 may be controlled to be brought into nonconduction when the rotational speed of the motor 5*a* reaches the predetermined rotational speed.

As is apparent from the foregoing description, according to the invention, the switching unit is inserted into the path of the motor-ground connection wire, the control of the opening/closing, that is, the conduction/nonconduction of electricity in the switching unit is performed by the control unit adapted to drive the motor. Thus, the leakage current flowing in the ground connection wire of the centrifugal separator can be reduced. Also, a plurality of electric shock guard means can be realized. Thus, it is unnecessary to use insulating materials as those of the rotating shaft of the motor and the rotor of the centrifugal separator. Consequently, the desired object of the invention can be achieved by employing a relatively simple configuration.

Although the invention accomplished by the present inventors has been described according to the embodiments, the invention is not limited to the aforementioned embodiments. Various modifications may be made without departing the gist of the invention.

What is claimed is:

1. A centrifugal separator comprising:

a motor housing that incorporates a motor serving as a rotary drive source;

a rotating shaft connected to said motor;

a rotor fixed to said rotating shaft and adapted to hold a sample to be separated;

a rotor chamber adapted to accommodate said rotor and to have an opening portion in a top surface thereof;

a door openably/closeably provided in said opening portion of said rotor chamber;

a door lock mechanism adapted to restrict the opening/closing of said door;

a door opening/closing detector adapted to detect opening/closing of said door;

a control unit adapted to control said motor and said door lock mechanism;

a casing adapted to accommodate said motor housing, said rotor chamber, said door lock mechanism, and said control unit, and to have an open part at said opening portion in said top surface of said rotor chamber so that said door is openably and closeably provided in said open part;

a ground connection wire adapted to electrically ground said motor housing; and a switching unit, which is adapted to be brought into electrical conduction or electrical nonconduction, being electrically connected between said motor housing and said motor-ground connection wire, wherein said switching unit is controlled by said control unit to be brought into electrical nonconduction when said door is closed.

2. The centrifugal separator according to claim 1, wherein, when said door is closed and said door lock mechanism locks said door, said switching unit is brought into electrical nonconduction.

3. The centrifugal separator according to claim 1, wherein, when said door is closed and said motor rotates, said switching unit is brought into electrical nonconduction.

4. The centrifugal separator according to claim 1, wherein, when said door is closed and a rotational speed of said motor exceeds a predetermined rotational speed, said switching unit is brought into electrical nonconduction.

5. A centrifugal separator comprising:

a motor housing that incorporates a motor serving as a rotary drive source;

a rotating shaft connected to said motor;

a rotor fixed to said rotating shaft and adapted to hold a sample to be separated;

a rotor chamber adapted to accommodate said rotor and to have an opening portion in a top surface thereof;

a door openably/closeably provided in said opening portion of said rotor chamber;

a door lock mechanism adapted to restrict the opening/closing of said door;

a control unit adapted to control said motor and said door lock mechanism;

a casing adapted to accommodate said motor housing, said rotor chamber, said door lock mechanism, and said control unit, and to have an open part at said opening portion in said top surface of said rotor chamber so that said door is openably and closeably provided in said opening portion;

a ground connection wire adapted to electrically ground said motor housing; and a switching unit, which is adapted to be brought into electrical conduction or electrical nonconduction, being electrically connected between said motor housing and said motor-ground connection wire, wherein said switching unit is controlled by said control unit to be brought into electrical nonconduction when said door lock mechanism locks said door.

6. The centrifugal separator according to claim 5, wherein, when said motor rotates, said switching unit is brought into electrical nonconduction.

7. The centrifugal separator according to claim 5, wherein, when a rotational speed of said motor exceeds a predetermined rotational speed, said switching unit is brought into electrical nonconduction.

8. A centrifugal separator comprising:

a motor housing that incorporates a motor serving as a rotary drive source;

a rotating shaft connected to said motor;

a rotor fixed to said rotating shaft and adapted to hold a sample to be separated;

a rotor chamber adapted to accommodate said rotor and to have an opening portion in a top surface thereof;

a door openably/closeably provided in said opening portion of said rotor chamber;

a door lock mechanism adapted to restrict the opening/closing of said door;

a door opening/closing detector adapted to detect opening/closing of said door;

a control unit adapted to control said motor and said door lock mechanism;

a casing adapted to accommodate said motor housing, said rotor chamber, said door lock mechanism, and said control unit, and to have an open part at said opening portion in said top surface of said rotor chamber so that said door is openably and closeably provided in said open part;

a ground connection wire adapted to electrically ground said motor housing; and a switching unit, which is adapted to be brought into electrical conduction or electrical nonconduction, being electrically connected between said motor housing and said motor-ground connection wire, wherein said switching unit is controlled by said control unit to be brought into electrical nonconduction when said motor rotates.

9. The centrifugal separator according to claim 8, wherein, when said motor rotates and said door is closed, said switching unit is brought into electrical nonconduction.

10. A centrifugal separator comprising:

a motor housing that incorporates a motor serving as a rotary drive source;

a rotating shaft connected to said motor;

a rotor fixed to said rotating shaft and adapted to hold a sample to be separated;

a rotor chamber adapted to accommodate said rotor and to have an opening portion in a top surface thereof;

a door openably/closeably provided in said opening portion of said rotor chamber;

a door lock mechanism adapted to restrict the opening/closing of said door;

a door opening/closing detector adapted to detect opening/closing of said door;

a control unit adapted to control said motor and said door lock mechanism;

a casing adapted to accommodate said motor housing, said rotor chamber, said door lock mechanism, and said control unit, and to have an open part at said opening portion in said top surface of said rotor chamber so that said door is openably and closeably provided in said open part;

a ground connection wire adapted to electrically ground said motor housing; and a switching unit, which is adapted to be brought into electrical conduction or electrical nonconduction, being electrically connected between said motor housing and said motor-ground connection wire, wherein said switching unit is controlled by said control unit to be brought into electrical nonconduction when rotational speed of said motor exceeds a predetermined rotational speed.

11. The centrifugal separator according to claim 10, wherein, when said rotational speed of said motor exceeds said predetermined rotational speed and said door is closed, said switching unit is brought into electrical nonconduction.

* * * * *